US009745979B2

(12) United States Patent
Stavale et al.

(10) Patent No.: US 9,745,979 B2
(45) Date of Patent: Aug. 29, 2017

(54) METHOD FOR ROTARY POSITIVE DISPLACEMENT PUMP PROTECTION

(71) Applicant: ITT MANUFACTURING ENTERPRISES LLC, Wilmington, DE (US)

(72) Inventors: Anthony E. Stavale, Victor, NY (US); Robert Semidey, Fairport, NY (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 1028 days.

(21) Appl. No.: 13/859,899

(22) Filed: Apr. 10, 2013

(65) Prior Publication Data

US 2014/0119966 A1 May 1, 2014

Related U.S. Application Data

(60) Provisional application No. 61/622,684, filed on Apr. 11, 2012.

(51) Int. Cl.
*F04C 28/28* (2006.01)
*F04C 14/28* (2006.01)

(52) U.S. Cl.
CPC ..... *F04C 28/28* (2013.01); *F04C 14/28* (2013.01); *F04C 2270/025* (2013.01);
(Continued)

(58) Field of Classification Search
CPC ..... F04C 28/28; F04C 14/28
(Continued)

(56) References Cited

U.S. PATENT DOCUMENTS 5,754,421 A 5/1998 Nystrom
5,930,092 A 7/1999 Nystrom
(Continued)

FOREIGN PATENT DOCUMENTS

CN 1977115 6/2007
CN 201730825 2/2011
WO 01/88379 11/2001

OTHER PUBLICATIONS

CN1977115 English Language Abstract (2 pages).
CN201730825 English Language Abstract (1 page).

*Primary Examiner* — Miranda Huang
*Assistant Examiner* — Sivalingam Sivanesan
(74) *Attorney, Agent, or Firm* — Ware, Fressola, Maguire & Barber LLP

(57) ABSTRACT

Techniques are provided for protecting a rotary positive displacement pump, e.g., using a signal processor that receives signaling containing information about power, torque, speed, viscosity and specific gravity related to the operation of a pump; and determines whether to enter an enhanced pump protection mode for the rotary positive displacement pump based at least partly on a relationship between an actual corrected tune ratio and a tuned ratio set point (Tune Ratio SP). The signal processor may determine if the actual corrected tune ratio is less than or equal to the actual corrected tune ratio set point (Tune Ratio SP), and if so, then to enter the enhanced pump protection mode, else continues to use a basic pump protection mode, and also determines the actual corrected tune ratio based upon a ratio of an actual corrected power (PAcorr) divided by a tuned corrected power (PTcorr) at a specific operating speed.

45 Claims, 4 Drawing Sheets

(52) U.S. Cl.
CPC .... *F04C 2270/03* (2013.01); *F04C 2270/052* (2013.01); *F04C 2270/86* (2013.01)

(58) Field of Classification Search
USPC ..... 700/282
See application file for complete search history.

(56) References Cited

U.S. PATENT DOCUMENTS

| | | | | |
|---|---|---|---|---|
| 7,330,779 | B2 * | 2/2008 | Schulz | E21B 41/0021 417/44.11 |
| 2004/0062658 | A1 * | 4/2004 | Beck | E21B 43/126 417/42 |
| 2005/0252205 | A1 * | 11/2005 | Stavale | F04D 15/0254 60/445 |
| 2007/0154321 | A1 * | 7/2007 | Stiles, Jr. | F04B 49/20 417/44.1 |
| 2007/0212229 | A1 * | 9/2007 | Stavale | F04D 15/0088 417/42 |

* cited by examiner

METHOD FOR ROTARY POSITIVE DISPLACEMENT PUMP PROTECTION

CROSS-REFERENCE TO RELATED APPLICATIONS

This application claims benefit to provisional patent application Ser. No. 61/622,684, filed 11 Apr. 2012, which is hereby incorporated by reference in its entirety.

BACKGROUND OF THE INVENTION

1. Field of the Invention

This application relates to a rotary positive displacement pump, such as an internal or external gear pump, a lobe pump, a vane pump or a progressive cavity pump; and more particularly, relates to techniques for protection, e.g., for a dry run condition, for such a rotary positive displacement pump.

2. Brief Description of Related Art

Many different types or kinds of pumps and external protective devices, including rotary positive displacement pumps with external protection devices, are known in the art. By way of example, some known external protection device disadvantages associated with the same and set forth below:

One known device PMP 25, provided by a company named Load Controls, Inc. (Sturbridge, Mass.), uses a load monitor technique that provides pump protection by observing the motor amperage draw and speed and then correlating the resulting power reading to various operating conditions (e.g. dry running, closing valves). See U.S. Pat. Nos. 5,930,092 and 5,754,421, which are hereby incorporated by reference in their entirety. One disadvantage of this known device is that it is suitable only for constant speed applications and fails to distinguish control differentiation from various system upset conditions.

Another known device, provided by a company named ABB Industry Oy (Helsinki, Finland), uses a technique based on a variable frequency drive that has parameters that allow maximum and minimum torque values to be configured to prevent the load driver (motor) from operating outside of these parameters. One disadvantage of this variable frequency drive technique is that it does not provide logic for interpreting normal operating conditions from system upsets, such as distinguishing between a higher power requirement due to increased system resistance versus a higher torque condition caused by dry running.

Other known devices consist of flow or pressure switches or liquid presence/absence detectors to identify undesired operating conditions. However, the use of additional process flow or pressure switches adds cost and complexity to the drive system, a potential failure point, and unnecessary cost.

U.S. patent application Ser. No. 11/601,373, filed 17 Nov. 2006, entitled "Pump Protection Without the Use of Traditional Sensors," by A. Stavale et al., which was published as U.S. 2007/0212229 A1 and is incorporated by reference in its entirety, sets forth techniques for providing pump protection for centrifugal pumps. Centrifugal pumps have a very different principle of operation than do rotary positive displacement pumps. In centrifugal pumps power varies as the cube of the speed change (FIG. 1) and torque varies as the square of the speed change. In addition, the tune process for dry run protection of centrifugal pumps described in patent application Ser. No. 11/601,373 is performed at a closed valve condition. The tune process for dry run protection of rotary positive displacement pumps could not be performed at the closed valve condition, since rotary positive displacement pumps will quickly destroy itself if operated at closed valve condition without intervention. For these reasons, the techniques disclosed in patent application Ser. No. 11/601,373 would not be applied to rotary positive displacement pumps.

None of the aforementioned patents or publications teach or suggest the technique described herein for providing pump protection for rotary positive displacement pumps, as set forth below.

SUMMARY OF THE INVENTION

The present invention provides new and unique techniques for protecting rotary positive displacement pumps, while differentiating between dangerous operating conditions such as dry running which can result in catastrophic damage if left to operate without intervention. Examples of rotary positive displacement pumps are internal or external gear pumps, lobe pumps, vane pumps and progressive cavity pumps. The methodology relies on two types of protection to increase robustness and response time. Providing a robust pump protection solution while avoiding nuisance faults can be difficult. In order to use power, or torque measurements to detect a dry run condition the following must be considered: power and torque varies with specific gravity, viscosity, differential pressure and speed changes. Speed is the easiest parameter to contend with as it can be measured directly. For varying temperature systems the power and torque comparisons must all be evaluated at a common specific gravity and viscosity. Therefore power and torque readings are corrected to rated conditions for specific gravity and viscosity changes before any evaluation is done. This can be achieved by entering the specific gravity and viscosity vs. temperature curves in the controller. A simple temperature measuring device can then be used to correct power readings.

For constant temperature systems, corrections to power readings are not required and the protection method does not require traditional sensors.

Preventing nuisance faults is another important problem to resolve. This can occur when changes in power readings are due to a changing system condition; e.g. increases or decreases in discharge pressure. The change in power readings must be distinguished between normal system changes and increased or decreased power draw due to internal rubbing contact or dry run conditions. This is achieved in part by the basic pump protection algorithm where a speed change associated with changing conditions is allowed to re-stabilize at a constant speed with a +/− change. Once stabilized new power readings are sampled.

The enhanced pump protection algorithm can distinguish between a torque ripple signature during normal operation and a torque ripple signature during a condition where the pump is in distress. If the torque ripple exceeds a predefined set point, then a dry run fault is declared.

The enhanced pump protection methodology can protect against difficult to detect dry run conditions which the basic pump protection algorithm cannot. These conditions occur at low operating speeds (e.g., down to 20:1 turndown from full load motor speed) and in systems operating at a low differential pressure.

The purpose of the new and unique pump protection is to provide a faster and more robust response to a dry run condition when the corrected tune ratio is greater than the tune ratio set point. Tune ratios above the set point value are associated with higher differential pressures. In this case, a response to a dry run condition can be identified more quickly than in enhanced protection methodology. The logic for these algorithms, for example, can be embedded in a variable frequency drive (VFD) or a programmable logic controller (PLC).

The Apparatus

According to some embodiments, the present invention may take the form of apparatus comprising a signal processor that may be configured to

- receive signaling containing information about power, torque and speed related to the operation of a rotary positive displacement pump; and
- determine whether to enter an enhanced pump protection mode for the rotary positive displacement pump based at least partly on a relationship between an actual corrected tune ratio and a tuned ratio set point (Tune Ratio SP).

According to some embodiments of the present invention, the signal processor may be configured to determine if the actual corrected tune ratio is less than or equal to the actual corrected tune ratio set point (Tune Ratio SP), and if so, then to enter the enhanced pump protection mode, else to continue to use a basic pump protection mode.

According to some embodiments of the present invention, the signal processor may be configured to determine the actual corrected tune ratio based at least partly on a ratio of an actual corrected power (PAcorr) divided by a tuned corrected power (PTcorr) at a specific operating speed.

According to some embodiments of the present invention, the signal processor may also be configured to determine the actual corrected power (PAcorr) based at least partly on a relationship between an actual power (PACT) at the current speed, a rated specific gravity (SGRTD) of the fluid being pumped, an actual specific gravity (SGACT) of the fluid being pumped, a rated viscosity (VISCRTD) of the fluid being pumped, an actual viscosity (VISCACT) of the fluid being pumped. For example, the signal processor may be configured to determine the actual corrected power (PAcorr) based at least partly on the equation:

$$PAcorr=PACT\times(SGRTD/SGACT)/(VISCRTD/VISCACT)^{0.275}.$$

According to some embodiments of the present invention, the signal processor may be configured to determine the tuned corrected power (PTcorr) based at least partly on a relationship between a measured or interpolated tuned value power (PMEAS) at the current speed, a rated specific gravity (SGRTD) of the fluid being pumped, an actual specific gravity (SGACT) of the fluid being pumped, a rated viscosity (VISCRTD) of the fluid being pumped, an actual viscosity (VISCACT) of the fluid being pumped. For example, the signal processor may be configured to determine the tuned corrected power (PTcorr) based at least partly on the equation:

$$PTcorr=PMEAS\times(SGRTD/SGACT)/(VISCRTD/VISCACT)^{0.275}.$$

According to some embodiments of the present invention, the tuned ratio set point (Tune Ratio SP) may include a default setting, e.g., including one default setting of about 2.0 for rotary positive displacement pumps that include a gear, lobe or vane pump, or including another default setting of about 1.3 for a progressive cavity rotary positive displacement pump.

According to some embodiments of the present invention, the signal processor may be configured to provide a control signal containing information to control the operation of the rotary positive displacement pump, including shutting the rotary positive displacement pump off when a dry run condition is determined in the enhanced pump protection mode.

According to some embodiments of the present invention, the signal processor may also be configured as, or take the form of, a controller that controls the operation of the rotary positive displacement pump.

According to some embodiments of the present invention, the apparatus may include the rotary positive displacement pump itself in combination with the signal processor, including where the rotary positive displacement pump takes the form of an internal or external gear pump, or a lobe pump, or a vane pump, or a progressive cavity pump, as well as other types or kind of rotary positive displacement pumps either now known or later developed in the future.

Enhanced Pump Protection Mode for Internal or External Gear, Lobe or Vane Pumps According to some embodiments of the present invention, when in the enhanced pump protection mode for a gear, lobe or vane rotary positive displacement pump, the signal processor may be configured to determine if a torque ripple ratio is greater than or equal to a torque ripple set point; and if so, the signal processor is configured to declare a dry run fault based at least partly on a torque ripple during normal operating conditions being substantially less than in a dry run condition, else to operate the rotary positive displacement pump in a normal condition.

The signal processor may also be configured to compare highest or lowest torque values to the torque ripple set point during sample periods, including where a sample period depends on a monitor update rate.

The signal processor may also be configured to continuously compensate torque measurements for specific gravity and viscosity changes in systems where a process temperature is not constant.

The torque ripple set point may have a default setting, e.g., including about 1.10.

The signal processor may also be configured to perform each evaluation while the pump is, e.g., at +/− a constant speed in order to distinguish between increasing/decreasing discharge pressure and an upset condition.

The signal processor may also be configured to detect a speed change and restart a protection mode algorithm.

Enhanced Pump Protection Mode for Progressive Cavity Pumps

According to some embodiments of the present invention, when in the enhanced pump protection mode for a progressive cavity rotary positive displacement pump, the signal processor may be configured to determine a corrected high and low power ratio; and compare the corrected high and low power ratio to a high and low power ratio set point to determine if a dry run condition exists.

According to some embodiments of the present invention, the signal processor may be configured to determine if either $$PACT2CORR/PACT1CORR>=HI\ P\ RATIO\ SP$$

or $$PACT2CORR/PACT1CORR<=LO\ P\ RATIO\ SP;\ \text{and}$$

if so, then to declare a dry run fault, else to operate the pump in a normal condition, where PACT1CORR is a corrected power reading for specific gravity and viscosity and is a mode value over an initial sample period, PACT2CORR is a continuously updated corrected power reading for specific gravity and viscosity and is a mode value after the initial sample period, HI P RATIO SP is a default high power ratio set point, including a value of about 1.2, and LO P RATIO SP is a default low power ratio set point, including a value of about 0.8.

According to some embodiments of the present invention, the signal processor may be configured to determine the corrected power reading for specific gravity and viscosity based at least partly on the equation:

$$PACT1CORR=PACT\times(SGRTD/SGACT)/(VISCRTD/VISCACT)^{0.275}.$$

According to some embodiments of the present invention, the signal processor may be configured to update the value of PACT1CORR under, e.g., the following conditions: when +/− a predetermined rpm speed change occurs, during pump start-up and after a predetermined operating time elapses.

The Basic Pump Protection Mode

According to some embodiments of the present invention, when in a basic pump protection mode the signal processor may be configured to determine at the current operating speed if the actual corrected power (PAcorr) is less than or equal to a dry run factor (KDR) multiplied by the tuned corrected power (PTcorr), where the dry run factor (KDR) has a default setting, including about 0.9 and can be adjusted if nuisance trips occur; and if so, the signal processor is configured to declare a dry run fault, else to operate the pump in a normal condition.

According to some embodiments of the present invention, the signal processor may be configured to keep the basic pump protection mode always active.

The Method

According to some embodiments, the present invention may take the form of a method comprising: receiving with a signal processor signaling containing information about power, torque and speed related to the operation of a pump; and determining whether to enter an enhanced pump protection mode for the rotary positive displacement pump based at least partly on a relationship between an actual corrected tune ratio and a tuned ratio set point (Tune Ratio SP).

According to some embodiments of the present invention, the method may also include implementing one or more of the features set forth above.

DETAILED DESCRIPTION OF THE INVENTION

Figure 2:
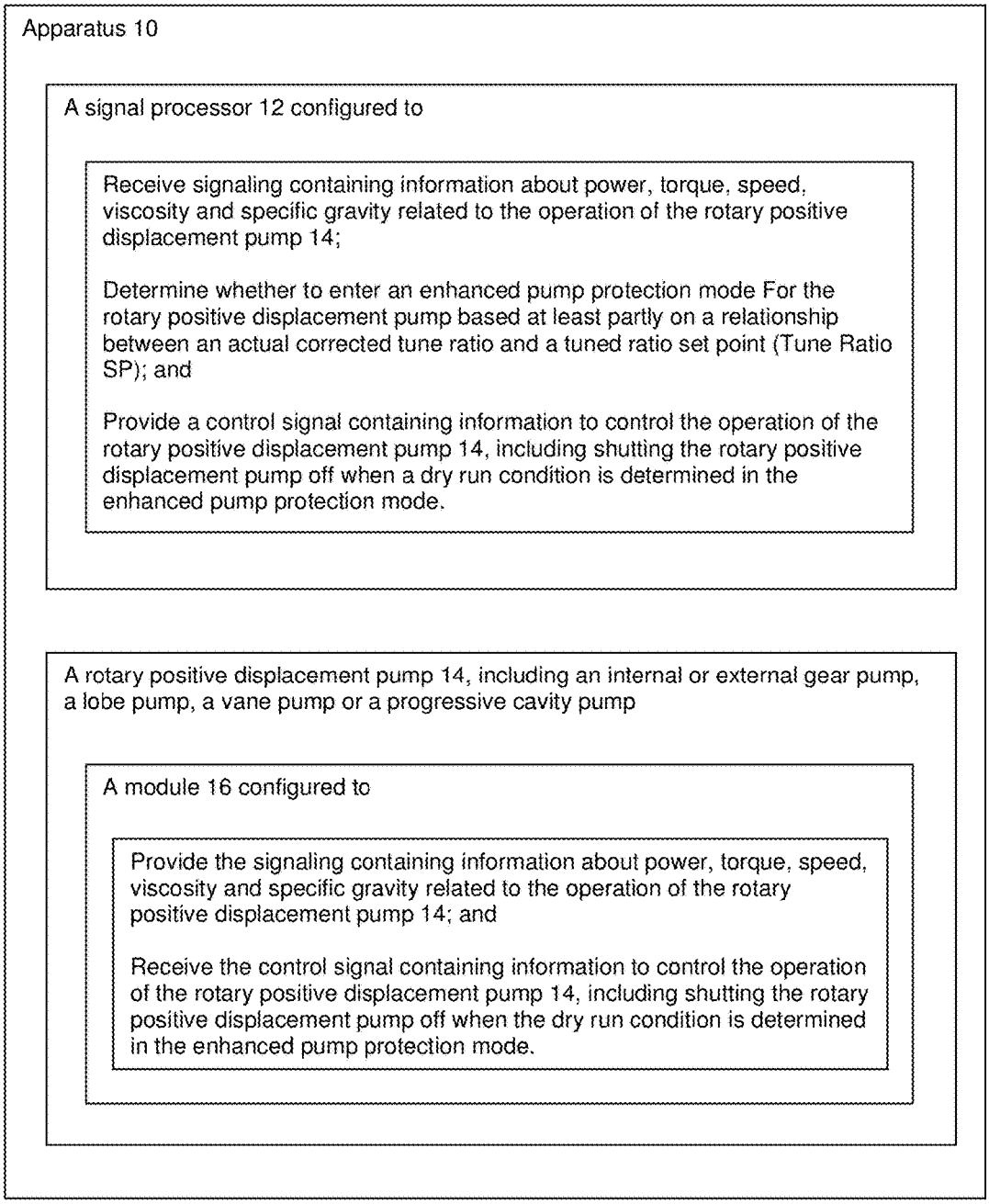
FIG. 2 is a block diagram of apparatus according to some embodiments of the present invention.

By way of example, as shown in FIG. 2, according to some embodiments, the present invention may take the form of apparatus 10 that includes a signal processor 12 configured to protect the operation a rotary positive displacement pump 14, e.g., which may include, or take the form of, an internal or external gear pump, a lobe pump, a vane pump or a progressive cavity pump.

The signal processor 12 may be configured to receive signaling containing information about power, torque, speed, viscosity and specific gravity related to the operation of the rotary positive displacement pump 14 and determine whether to enter an enhanced pump protection mode for the rotary positive displacement pump based at least partly on a relationship between an actual corrected tune ratio and a tuned ratio set point (Tune Ratio SP) else remain in the basic protection mode. The signal processor 12 may also be configured to provide a control signal containing information to control the operation of the rotary positive displacement pump 14, including shutting the rotary positive displacement pump off when a dry run condition is determined in the enhanced or basic pump protection mode.

The rotary positive displacement pump 14 may include a module 16 configured to provide the signaling containing information about power, torque, speed, viscosity and specific gravity related to the operation of the rotary positive displacement pump 14, and may also be configured to receive the control signal containing information to control the operation of the rotary positive displacement pump 14, including shutting the rotary positive displacement pump off when the dry run condition is determined in the enhanced or basic pump protection mode.

In operation, the signal processor 12 may be configured to determine if the actual corrected tune ratio is less than or equal to the actual corrected tune ratio set point (Tune Ratio SP), and if so, then to enter the enhanced pump protection mode, else to continue to use a basic pump protection mode. The signal processor 12 may be configured to determine the actual corrected tune ratio based at least partly on a ratio of an actual corrected power (PAcorr) divided by a tuned corrected power (PTcorr) at a specific operating speed. The logic for the basic and enhanced algorithms, for example, can be embedded in a variable frequency drive (VFD) or a programmable logic controller (PLC).

The implementation of the basic pump protection mode and the enhanced pump protection mode are set forth in detail below:

The Implementation

In effect, the present invention consists of two types of positive displacement pump protection control logic which utilize the direct feedback of power, torque, speed, viscosity and specific gravity to calculate an actual corrected tune ratio consisting of the actual corrected power divided by the tuned corrected power at a specific operating speed. The power measurements are continuously compensated for specific gravity and viscosity changes in systems where process temperature is not constant. The corrected actual tune ratio is then compared to a tune ratio set point in a decision tree algorithm. If the calculated tune ratio is greater than the tune ratio set point basic pump protection becomes active.

Figure 3:
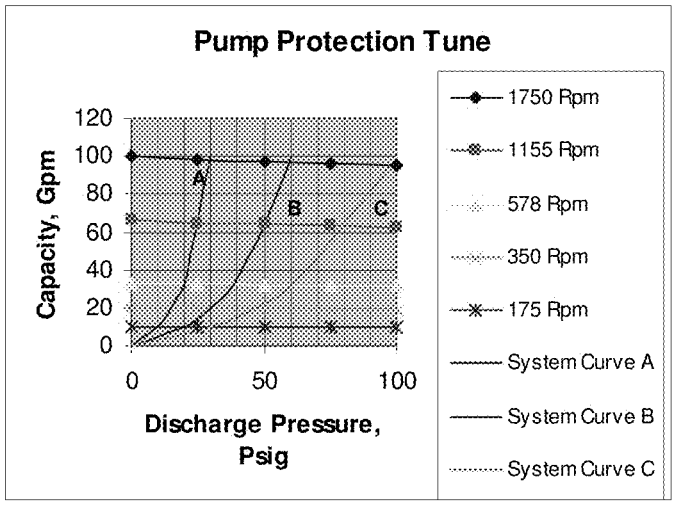
FIG. 3 is a graph of capacity (GPM) versus discharge pressure (PSIG) for a pump protection tune.

The process for activating pump protection is to first do a protective tune which samples speed and power data at three or more speeds while operating at rated conditions. (In contrast to techniques related to the tune process at the closed valve condition re centrifugal pumps, the tune process for dry run protection of rotary positive displacement pumps as described in this application is performed at rated conditions.) The protection functionality must be disabled during this process. If the pump is operating on a system with multiple system curves the protection tune should be performed with the pump operating on the system curve having least resistance. For the pump and system shown in FIG. 3 the protection tune would be performed while operating on system curve A. This is necessary to avoid nuisance dry run faults when transitioning between higher to lower discharge pressures.

Once the protection tune is completed the pump protection functionality can be enabled.

Figure 1:
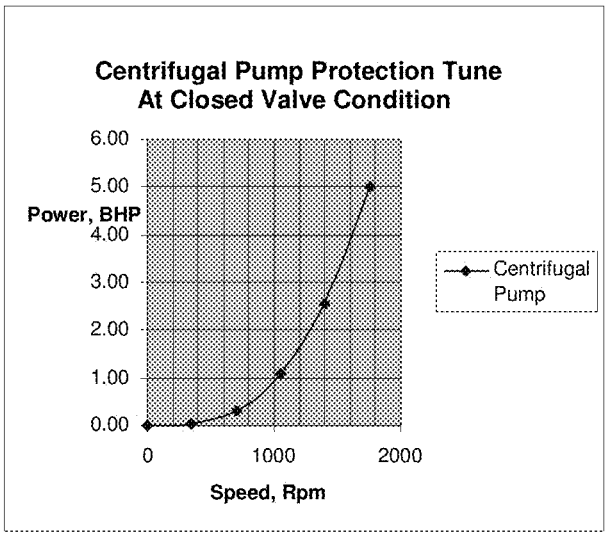
FIG. 1 is a graph of power (BHP) versus speed (RPM) for a centrifugal pump protection tune at a closed valve condition that is known in the art.
Figure 4:
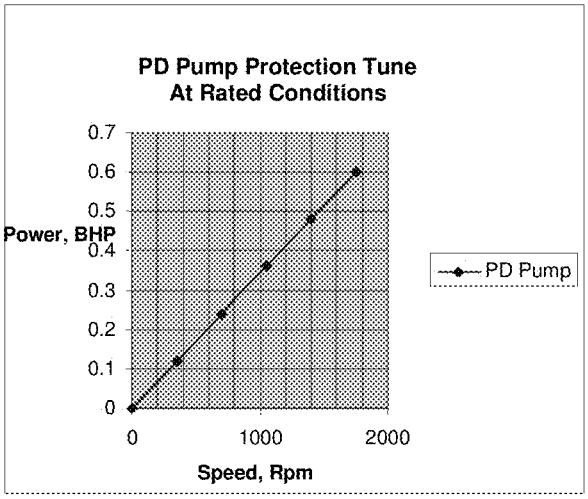
FIG. 4 is a graph of power (BHP) versus speed (RPM) for a rotary positive displacement pump protection tune at rated conditions.

In a positive displacement pump, the torque remains substantially constant for a constant differential pressure regardless of speed, and power will vary proportionally to the change in speed as shown in FIG. 4. The power curve in FIG. 4 for PD pumps varies directly with the change in speed (provided there is adequate suction pressure) for a given differential pressure. For centrifugal pumps power varies as the cube of the speed change (FIG. 1). Centrifugal pumps may operate at closed valve condition for short periods. It is not acceptable for positive displacement pumps to operate against a closed valve. Pressure will continue to build until pump damage occurs or the pump housing and/or piping ruptures.

After the protective tune has been completed and pump protection has been enabled the decision tree algorithm for basic pump protection becomes active as follows:

The Basic Pump Protection Mode

The following is an example of steps for the basic pump protection mode for a rotary positive displacement pump, including an internal or external gear pump, a lobe pump, a vane pump or a progressive cavity pump:

Pump Running

↓If true, then ←←

Pump at Constant+−Speed: If False, then →↑

↓If true, then

PAct Corr/PTune Corr<=Tune Ratio SP

If False, then →go to basic pump protection

If true, then →go to enhanced pump protection

The tune ratio at current operating speed is determined or calculated by the following set of equations:

PAct Corr/PTune Corr;

PACTCORR=PACT×(SGRTD/SGACT)/(VISCACT/VISCRTD)^0.275; and

PTUNECORR=PMEAS×(SGRTD/SGACT)/(VISCACT/VISCRTD)^0.275, where:

PACT=actual power at current speed,

PMEAS=measured or interpolated tuned value power at current speed,

SGRTD=rated specific gravity,

SGACT=actual specific gravity,

VISCRTD=rated viscosity, and

VISCACT=actual viscosity.

By way of example, for internal or external gear, lobe or vane PD pumps, the Tune Ratio SP (i.e. set point) has a default setting of 2.0; while for progressive cavity PD pumps, the Tune Ratio SP has a default setting of 1.3, although the scope of the invention is intended to include embodiments having a different default setting for the Tune Ratio SP consistent with that now known or later developed in the future.

If the basic pump protection is active, the following relationship is evaluated at the current operating speed by the equation:

PACTCORR<=KDR X PTUNECORR, where KDR is a dry run factor with a default setting of 0.9. (Note the KDR value can be adjusted by the user if nuisance trips occur.)

If PACTCORR<=KDR X PTUNECORR is false, then the condition of the PD pump is normal.

If PACTCORR<=KDR X PTUNECORR is true, then a dry run fault condition for the PD pump is declared.

Enhanced Pump Protection Mode

For rotary PD pumps, the enhanced pump protection mode may be used if the following condition is true:

PAct Corr/PTune Corr<=Tune Ratio SP

Consistent with that set forth below, one type of an enhanced pump protection mode is used for internal or external gear, lobe or vane PD pumps, and another type of an enhanced pump protection mode is used for progressive cavity PD pumps. In either enhanced pump protection mode, the basic pump protection may also remain active.

The Enhanced Pump Protection Mode for Internal or External Gear, Lobe or Vane Pumps For an internal or external gear, lobe or vane PD pump, the enhanced pump protection mode is based at least partly on the following torque ripple condition:

Torque Ripple Ratio>=Torque Ripple Set Point.

If the torque ripple condition is true, then→a dry run fault is declared for the internal or external gear, lobe or vane PD pump.

In contrast, if the torque ripple condition is false, then→the internal or external gear, lobe or vane PD pump has a normal condition.

Consistent with that set forth above, in this enhanced pump protection mode, the basic pump protection is always active, but enhanced pump protection (torque ripple) is only active when the tune ratio is less than or equal then the tune ratio set point.

In the enhanced pump protection mode, highest/lowest torque values may be compared to the torque ripple set point, e.g., during a 20 sample period. The sample period will typically depend on the monitor update rate. For example, for a 100 msec update rate the sample period is 2 sec. Note the torque measurements may be continuously compensated for specific gravity and viscosity changes in systems where the process temperature is not constant.

According to some embodiments of the present invention, the default setting for the torque ripple set point may be about 1.10, although the scope of the invention is intended to include embodiments having a different default setting consistent with that now known or later developed in the future.

Each evaluation may be performed while the pump is at +/− a constant speed in order to distinguish between increasing/decreasing discharge pressure and an upset condition. If a speed change is detected the algorithm restarts.

In rotary positive displacement pumps the torque ripple during normal operating conditions is substantially less than in a dry run condition. As the rotor begins to lose lubrication and friction increases the torque begins to spike as the rotor goes in and out of lubricating conditions.

Figure 5:
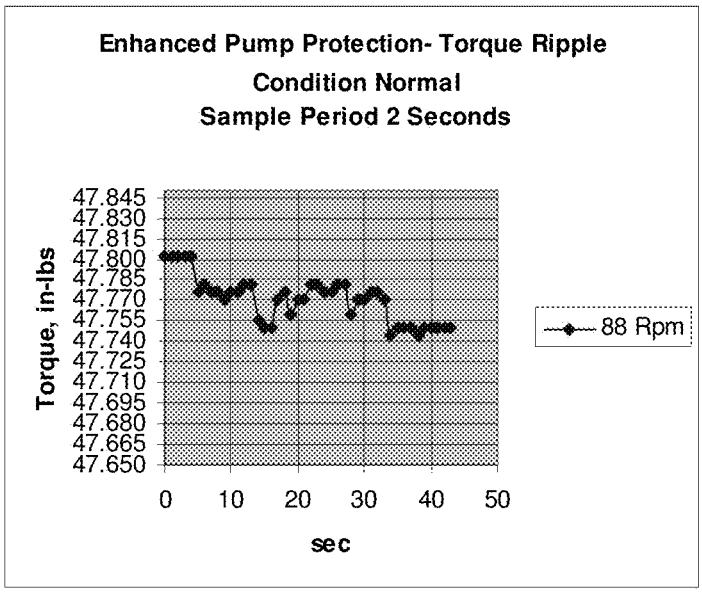
FIG. 5 is a graph of torque (in-lbs) versus time (sec) for enhanced pump protection—torque ripple condition normal.
Figure 6:
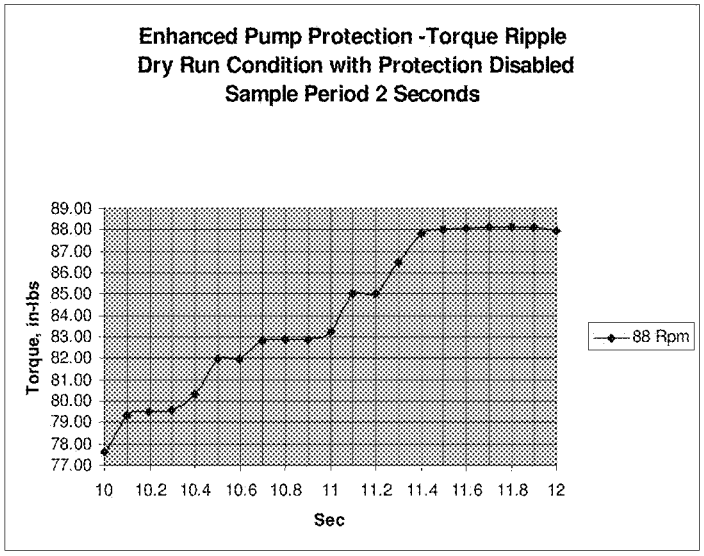
FIG. 6 is a graph of torque (in-lbs) versus time (sec) for enhanced pump protection—torque ripple dry run condition.

FIG. 5 shows a graph of torque (in-lbs) versus time (sec) as an example for enhanced pump protection—torque ripple condition normal. In FIG. 5, the normal operating conditions are shown at 88 rpm (20:1 turndown in maximum speed). For normal operation, the torque ripple is less than 1%. FIG. 5 also shows a 2 second snapshot of a dry run condition also at 88 rpm which quickly exceeds the torque ripple set point of 1.10. In contrast, and by way of comparison, FIG. 6 shows a graph of torque (in-lbs) versus time (sec) as an example for enhanced pump protection—torque ripple dry run condition.

Enhanced Pump Protection Mode for Positive Displacement Progressive Cavity Pumps For progressive cavity pumps, the algorithm for basic pump protection is very similar to other rotary positive displacement pumps including the requirement for a protective tune. However, the default setting for the tune ratio set point is 1.3 for this type of pump. For progressive cavity pumps it was found that torque ripple is not a reliable method for determining if a dry run condition exists. It has been found through testing that these types of pumps can have an unstable torque signature. Therefore, a different approach was taken for enhanced pump protection for this type of pump. The algorithm for enhanced pump protection calculates a corrected high and low power ratio and compares it to a high and low power ratio set point (HI P RATIO SP and LO P RATIO SP) to determine if a dry run condition exists.

By way of example, the enhanced pump protection mode is based at least partly on the following high/low power condition:

PACT2CORR/PACT1CORR)>=HI P RATIO SP or

PACT2CORR/PACT1CORR)<=LO P RATIO SP.

If either high/low power condition is true, then→ a dry run fault is declared for the progressive cavity PD pump.

In contrast, if the high/low power condition is false, then→ the progressive cavity PD pump has a normal condition.

The parameter PACT1CORR is a corrected power reading for specific gravity and viscosity as shown by the equation below:

PACTCORR=PACT×(SGRTD/SGACT)/(VISCACT/VISCRTD)^0.275.

For constant temperature systems no corrections are required.

By way of example, the value of PACT1CORR may be updated under the following conditions: when +/− an rpm speed change occurs, during a pump start-up and after a 1 hr operating time elapses, although the scope of the invention is intended to include embodiments having a different +/− rpm speed change and/or a different operating time elapsing consistent with that now known or later developed in the future. The value of PACT1CORR may be the mode value, e.g., over a predetermined sample period, e.g., a 20 sample period. The sample period will depend on the monitor update rate.

The value of PACT2CORR may be continuously updated using the aforementioned equation. The value of PACT2CORR may be the mode value, e.g., over a predetermined sample period, e.g., a 20 sample period.

The ratio of PACT2CORR/PACT1CORR may be continuously updated and compared to the high power ratio set point HI P RATIO SP and the low power ratio set point LO P RATIO SP. The calculated value of the ratio PACT2CORR/PACT1CORR may be based on the mode value, e.g., over a predetermined sample period, e.g., a 20 sample period.

The default set point for the high power ratio set point HI P RATIO SP may be, e.g. about 1.2, although the scope of the invention is intended to include embodiments having a different default set consistent with that now known or later developed in the future The default set point for the low power ratio set point LO P RATIO SP may be, e.g. about 0.80, although the scope of the invention is intended to include embodiments having a different default set consistent with that now known or later developed in the future.

Consistent with that set forth above, the above algorithms for the basic pump protection mode may always be active, but the enhanced pump protection mode is only active when the tune ratio is less than or equal then the tune ratio set point.

The Signal Processor 12

The signal processor 12 performs the basic signal processing functionality of the apparatus for implementing the present invention. The signal processor 12 may be a stand alone signal processing module, form part of a controller, controller module, etc., or form part of some other module of the apparatus 10. Many different types and kind of signal processors, controllers and controller modules for controlling pumps are known in the art, for example, including programmable logic controllers and variable frequency drives. By way of example, based on an understanding of such known signal processing modules, controllers and control modules, a person skilled in the art would be able to configure the signal processor 12 to perform the functionality consistent with that described herein, including to receive the signaling containing information about power, torque, speed, viscosity and specific gravity related to the operation of a rotary positive displacement pump; and to determine whether to enter an enhanced pump protection mode for the rotary positive displacement pump based at least partly on a relationship between an actual corrected tune ratio and a tuned ratio set point (Tune Ratio SP) else remain in the basic protection mode. By way of further example, based on an understanding of such known signal processing modules, controllers and control modules, a person skilled in the art would be able to configure the signal processor 14 to perform functionality consistent with that described herein, including to determine if the actual corrected tune ratio is less than or equal to the actual corrected tune ratio set point (Tune Ratio SP), and if so, then to enter the enhanced pump protection mode, else to continue to use a basic pump protection mode, as well as to determine the actual corrected tune ratio based at least partly on a ratio of an actual corrected power (PAcorr) divided by a tuned corrected power (PTcorr) at a specific operating speed.

By way of still further example, the functionality of the signal processor may be implemented using hardware, software, firmware, or a combination thereof, although the scope of the invention is not intended to be limited to any particular embodiment thereof. In a typical software implementation, such a module would be one or more microprocessor-based architectures having a microprocessor, a random access memory (RAM), a read only memory (ROM), input/output devices and control, data and address buses connecting the same. A person skilled in the art would be able to program such a microprocessor-based implementation to perform the functionality described herein without undue experimentation. The scope of the invention is not intended to be limited to any particular implementation using technology known or later developed in the future.

The signal processor, controller or controller module may include other modules to perform other functionality that is known in the art, that does not form part of the underlying invention, and that is not described in detail herein.

The Rotary Positive Displacement Pump 14

The rotary positive displacement pump like element 14, and rotary positive displacement pumps in general, are known in the art, e.g., which may include an internal or external gear pump, a lobe pump, a vane pump or a progressive cavity pump, and not described in detail herein. Moreover, the scope of the invention is not intended to be limited to any particular type or kind thereof that is either now known or later developed in the future. By way of example, such rotary positive displacement pumps are understood to include a motor or motor portion for driving a pump or pump portion, as well as some module like element 16 for example a programmable logic controller (PLC) or variable frequency drive (VFD) for implementing some functionality related to controlling the basic operation of the motor for driving the pump 14. By way of example, and consistent with that set forth herein, the motor is understood to receive control signals from the signal processor in order to drive and control the rotary positive displacement pump to pump fluid. The motor is also understood to provide the signaling containing information about power, torque and speed related to the operation of the pump.

Other Possible Applications

Other possible applications include at least the following:

Pump Protection Algorithms—sensorless dry run protection can provide a reliable method for positive displacement pump fault tolerance during system upset conditions or operator error. In constant temperature systems this can be achieved without the added cost and complexity of external sensors.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

We claim:

1. Apparatus comprising:

a signal processor configured to receive signaling containing information about power, torque and speed related to the operation of a rotary positive displacement pump; and determine a control signal containing information about whether to enter an enhanced pump protection mode for the rotary positive displacement pump based at least partly on the signaling received, and which depends on a relationship between an actual corrected tune ratio and a tuned ratio set point (Tune Ratio SP);

wherein the signal processor is configured to determine the actual corrected tune ratio based at least partly on a ratio of an actual corrected power (PAcorr) divided by a tuned corrected power (PTcorr) at a specific operating speed.

2. Apparatus according to claim 1, wherein the signal processor is configured to determine the actual corrected power (PAcorr) based at least partly on a relationship between an actual power (PACT) at the current speed, a rated specific gravity (SGRTD) of the fluid being pumped, an actual specific gravity (SGACT) of the fluid being pumped, a rated viscosity (VISCRTD) of the fluid being pumped, an actual viscosity (VISCACT) of the fluid being pumped.

3. Apparatus according to claim 2, wherein the signal processor is configured to determine the actual corrected power (PAcorr) based at least partly on the equation:

$$PAcorr=PACT\times(SGRTD/SGACT)/(VISCRTD/VISCACT)^{0.275}.$$

4. Apparatus according to claim 1, wherein the signal processor is configured to determine the tuned corrected power (PTcorr) based at least partly on a relationship between a measured or interpolated tuned value power (PMEAS) at the current speed, a rated specific gravity (SGRTD) of the fluid being pumped, an actual specific gravity (SGACT) of the fluid being pumped, a rated viscosity (VISCRTD) of the fluid being pumped, an actual viscosity (VISCACT) of the fluid being pumped.

5. Apparatus according to claim 4, wherein the signal processor is configured to determine the tuned corrected power (PTcorr) based at least partly on the equation:

$$PTcorr=PMEAS\times(SGRTD/SGACT)/(VISCRTD/VISCACT)^{0.275}.$$

6. Apparatus according to claim 1, wherein, when in a basic pump protection mode, the signal processor is configured to determine at the current operating speed if the actual corrected power (PAcorr) is less than or equal to a dry run factor (KDR) multiplied by the tuned corrected power (PTcorr), where the dry run factor (KDR) has a default setting, including about 0.9; and if so, the signal processor is configured to declare a dry run fault, else to operate the pump in a normal condition.

7. Apparatus comprising:

a signal processor configured to receive signaling containing information about power, torque and speed related to the operation of a rotary positive displacement pump in a basic pump protection mode; and determine a control signal containing information about whether to enter an enhanced pump protection mode for the rotary positive displacement pump based at least partly on the signaling received, and which depends on a relationship between an actual corrected tune ratio and tuned ratio set point (Tune Ratio SP), wherein the tuned ratio set point (Tune Ratio SP) includes a default setting, including one default setting of about 2.0 for the rotary positive displacement pumps that include a gear, lobe or vane pump, or including another default setting of about 1.3 for the rotary positive displacement pumps that include a progressive cavity pump.

8. Apparatus according to claim 7, wherein the signal processor is configured to determine if the actual corrected tune ratio is less than or equal to an actual corrected tune ratio set point (Tune Ratio SP), and if so, then to enter the enhanced pump protection mode, else to continue to use the basic pump protection mode.

9. Apparatus according to claim 7, wherein the signal processor is configured to provide the control signal to control the operation of the rotary positive displacement pump, including shutting the rotary positive displacement pump off when a dry run condition is determined.

10. Apparatus according to claim 7, wherein the signal processor comprises, or takes the form of, a controller configured to control the operation of the pump.

11. Apparatus according to claim 7, wherein the apparatus comprises the rotary positive displacement pump, including an internal or external gear pump, or a lobe pump, or a vane pump, or a progressive cavity pump.

12. Apparatus according to claim 7, wherein the signal processor is configured to keep the basic pump protection mode always active.

13. Apparatus comprising:

a signal processor configured to receive signaling containing information about power, torque and speed related to the operation of a rotary positive displacement pump; and determine a control signal containing information about whether to enter an enhanced pump protection mode for the rotary positive displacement pump based at least partly on the signaling received, and which depends on a relationship between an actual corrected tune ratio and a tuned ratio set point (Tune Ratio SP);

wherein, when in the enhanced pump protection mode for a gear, lobe or vane rotary positive displacement pump, the signal processor is also configured to determine if a torque ripple ratio is greater than or equal to a torque ripple set point; and if so, the signal processor is configured to declare a dry run fault based at least partly a torque ripple during normal operating conditions being substantially less than in a dry run condition, else to operate the pump in a normal condition.

14. Apparatus according to claim 13, wherein the signal processor is also configured to compare highest or lowest torque values to the torque ripple set point during sample periods, including where a sample period depends on a monitor update rate.

15. Apparatus according to claim 13, wherein the signal processor is configured to compensate torque measurements continuously for specific gravity and viscosity changes in systems where a process temperature is not constant.

16. Apparatus according to claim 13, wherein the torque ripple set point has a default setting, including about 1.10.

17. Apparatus according to claim 13, wherein the signal processor is configured to perform each evaluation while the pump is at +/− a constant speed in order to distinguish between increasing/decreasing discharge pressure and an upset condition.

18. Apparatus according to claim 17, wherein the signal processor is configured to detect a speed change and restart a protection mode algorithm.

19. Apparatus comprising:

a signal processor configured to receive signaling containing information about power, torque and speed related to the operation of a rotary positive displacement pump; and determine a control signal containing information about whether to enter an enhanced pump protection mode for the rotary positive displacement pump based at least partly on the signaling received, and which depends on a relationship between an actual corrected tune ratio and a tuned ratio set point (Tune Ratio SP);

wherein when in the enhanced pump protection mode, including where the rotary positive displacement pump takes the form of a progressive cavity pump, the signal processor is configured to:

determine a corrected high and low power ratio; and compare the corrected high and low power ratio to a high and low power ratio set point to determine if a dry run condition exists.

20. Apparatus according to claim 19, wherein the signal processor is configured to determine if either

PACT2CORR/PACT1CORR>=HI P RATIO SP or

PACT2CORR/PACT1CORR<=LO P RATIO SP; and if so, then to declare a dry run fault, else to operate the pump in a normal condition, where PACT1CORR is a corrected power reading for specific gravity and viscosity and is a mode value over an initial sample period, PACT2CORR is a continuously updated corrected power reading for specific gravity and viscosity and is a mode value after the initial sample period, HI P RATIO SP is a default high power ratio set point, including the value of about 1.2, and LO P RATIO is a default low power ratio set point, including the value of about 0.8.

21. Apparatus according to claim 19, wherein the signal processor is configured to determine the corrected power reading for specific gravity and viscosity based at least partly on the equation:

$$PACT1\ CORR=PACT\times(SGRTD/SGACT)/(VISCRTD/VISCACT)^{0.275}.$$

22. Apparatus according to claim 19, wherein the signal processor is configured to update the value of PACT1 CORR under the following conditions: when +/− a predetermined rpm speed change occurs, during pump start-up and after a predetermined operating time elapses.

23. A method comprising:

receiving with a signal processor signaling containing information about power, torque and speed related to the operation of a pump; and determine with the signal processor a control signal containing information about whether to enter an enhanced pump protection mode for the rotary positive displacement pump based at least partly on the signaling received, and which depends on a relationship between an actual corrected tune ratio and a tuned ratio set point (Tune Ratio SP);

wherein the method comprises determining with the signal processor the actual corrected tune ratio based at least partly on a ratio of an actual corrected power (PAcorr) divided by a tuned corrected power (PTcorr) at a specific operating speed.

24. A method according to claim 23, wherein the signal processor is configured to determine the actual corrected power (PAcorr) based at least partly on a relationship between an actual power (PACT) at the current speed, a rated specific gravity (SGRTD) of the fluid being pumped, an actual specific gravity (SGACT) of the fluid being pumped, a rated viscosity (VISCRTD) of the fluid being pumped, an actual viscosity (VISCACT) of the fluid being pumped.

25. A method according to claim 24, wherein the method comprises determining with the signal processor the actual corrected power (PAcorr) based at least partly on the equation:

$$PAcorr=PACT\times(SGRTD/SGACT)/(VISCRTD/VISCACT)^{0.275}.$$

26. A method according to claim 23, wherein the method comprises determining with the signal processor the tuned corrected power (PTcorr) based at least partly on a relationship between a measured or interpolated tuned value power (PMEAS) at the current speed, a rated specific gravity (SGRTD) of the fluid being pumped, an actual specific gravity (SGACT) of the fluid being pumped, a rated viscosity (VISCRTD) of the fluid being pumped, an actual viscosity (VISCACT) of the fluid being pumped.

27. A method according to claim 26, wherein the method comprises determining with the signal processor the tuned corrected power (PTcorr) based at least partly on the equation:

$$PTcorr=PMEAS\times(SGRTD/SGACT)/(VISCRTD/VISCACT)^{0.275}.$$

28. A method comprising:

receiving with a signal processor signaling containing information about power, torque and speed related to the operation of a pump; and determine with the signal processor a control signal containing information about whether to enter an enhanced pump protection mode for the rotary positive displacement pump based at least partly on the signaling received, and which depends on a relationship between an actual corrected tune ratio and a tuned ratio set point (Tune Ratio SP);

wherein the tuned ratio set point (Tune Ratio SP) includes a default setting, including one default setting of about 2.0 for the rotary positive displacement pumps that include a gear, lobe or vane pump, or including another default setting of about 1.3 for the rotary positive displacement pumps that include a progressive cavity pump.

29. A method according to claim 28, wherein the method comprises determining with the signal processor if the actual corrected tune ratio is less than or equal to an actual corrected tune ratio set point (Tune Ratio SP), and if so, then to enter the enhanced pump protection mode, else to continue to use the basic pump protection mode.

30. A method according to claim 28, wherein the method comprises providing with the signal processor the control signal to control the operation of the rotary positive displacement pump, including shutting the rotary positive displacement pump off when a dry run condition is determined.

31. A method according to claim 28, wherein the method comprises keeping with the signal processor the basic pump protection mode always active.

32. A method comprising:

receiving with a signal processor signaling containing information about power, torque and speed related to the operation of a pump; and determine with the signal processor a control signal containing information about whether to enter an enhanced pump protection mode for the rotary positive displacement pump based at least partly on the signaling received, and which depends on a relationship between an actual corrected tune ratio and a tuned ratio set point (Tune Ratio SP);

wherein the method comprises, when in the enhanced pump protection mode for a gear, lobe or vane rotary positive displacement pump, determining if a torque ripple ratio is greater than or equal to a torque ripple set point; and if so, the signal processor is configured to declare a dry run fault based at least partly a torque ripple during normal operating conditions being substantially less than in a dry run condition, else to operate the pump in a normal condition.

33. A method according to claim 32, wherein the method comprises comparing with the signal processor highest or lowest torque values to the torque ripple set point during sample periods, including where a sample period depends on a monitor update rate.

34. A method according to claim 32, wherein the method comprises continuously compensating with the signal processor torque measurements for specific gravity and viscosity changes in systems where a process temperature is not constant.

35. A method according to claim 32, wherein the torque ripple set point has a default setting, including about 1.10.

36. A method according to claim 32, wherein the method comprises performing with the signal processor each evaluation while the pump is at +/− a constant speed in order to distinguish between increasing/decreasing discharge pressure and an upset condition.

37. A method according to claim 36, wherein the method comprises detecting with the signal processor a speed change and restart a protection mode algorithm.

38. A method comprising:

receiving with a signal processor signaling containing information about power, torque and speed related to the operation of a pump; and determine with the signal processor a control signal containing information about whether to enter an enhanced pump protection mode for the rotary positive displacement pump based at least partly on the signaling received, and which depends on a relationship between an actual corrected tune ratio and a tuned ratio set point (Tune Ratio SP);

wherein when in the enhanced pump protection mode, including where the rotary positive displacement pump takes the form of a progressive cavity pump, the method comprises:

determining with the signal processor a corrected high and low power ratio; and comparing with the signal processor the corrected high and low power ratio to a high and low power ratio set point to determine if a dry run condition exists.

39. A method according to claim 38, wherein the method comprises determining with the signal processor if either

PACT2CORR/PACT1CORR>=HI P RATIO SP or

PACT2CORR/PACT1CORR<=LO P RATIO SP; and if so, then declaring with the signal processor a dry run fault, else operating with the signal processor the pump in a normal condition, where PACT1CORR is a corrected power reading for specific gravity and viscosity and is a mode value over an initial sample period, PACT2CORR is a continuously updated corrected power reading for specific gravity and viscosity and is a value after the initial sample period, HI P RATIO SP is a default high power ratio set point, including the value of about 1.2, and LO P RATIO SP is a default low power ratio set point, including the value of about 0.8.

40. A method according to claim 39, wherein the method comprises determining with the signal processor the corrected power reading for specific gravity and viscosity based at least partly on the equation:

$$PACT1CORR=PACT\times(SGRTD/SGACT)/(VISCRTD/VISCACT)^{0.275}.$$

41. A method according to claim 39, wherein the method comprises updating with the signal processor the value of PACT1CORR under the following conditions: when +/− a predetermined rpm speed change occurs, during pump start-up and after a predetermined operating time elapses.

42. A method comprising:

receiving with a signal processor signaling containing information about power, torque and speed related to the operation of a pump; and determine with the signal processor a control signal containing information about whether to enter an enhanced pump protection mode for the rotary positive displacement pump based at least partly on the signaling received, and which depends on a relationship between an actual corrected tune ratio and a tuned ratio set point (Tune Ratio SP);

wherein, when in a basic pump protection mode, the method comprises determining with the signal processor at the current operating speed if the actual corrected power (PAcorr) is less than or equal to a dry run factor (KDR) multiplied by the tuned corrected power (PTcorr), where the dry run factor (KDR) has a default setting, including about 0.9 and can be adjusted if nuisance trips occur; and if so, declaring with the signal processor a dry run fault, else operating with the signal processor the pump in a normal condition.

43. Apparatus comprising:

means for receiving signaling containing information about power, torque and speed related to the operation of a rotary positive displacement pump in a basic pump protection mode; and means for determining a control signal containing information about whether to enter an enhanced pump protection mode for the rotary positive displacement pump based at least partly on the signaling received, and which depends a relationship between an actual corrected tune ratio and a tuned ratio set point (Tune Ratio SP), wherein the tuned ratio set point (Tune Ratio SP) includes a default setting, including one default setting of about 2.0 for the rotary positive displacement pumps that include a gear, lobe or vane pump, or including another default setting of about 1.3 for the rotary positive displacement pumps that include a progressive cavity pump.

44. A method according to claim 43, wherein the means for determining includes determining if the actual corrected tune ratio is less than or equal to an actual corrected tune ratio set point (Tune Ratio SP), and if so, then to enter the enhanced pump protection mode, else to continue to use the basic pump protection mode.

45. Apparatus comprising:

means for receiving signaling containing information about power, torque and speed related to the operation of a pump; and means for determining a control signal containing information about whether to enter an enhanced pump protection mode for the rotary positive displacement pump based at least partly on the signaling received, and which depends a relationship between an actual corrected tune ratio and a tuned ratio set point (Tune Ratio SP);

wherein the means for determining includes determining the actual corrected tune ratio based at least partly on a ratio of an actual corrected power (PAcorr) divided by a tuned corrected power (PTcorr) at a specific operating speed.

* * * * *